US009113739B2

(12) United States Patent
Thomas

(10) Patent No.: US 9,113,739 B2
(45) Date of Patent: Aug. 25, 2015

(54) MAGNETIC WINDOW VALANCE

(71) Applicant: Window Wear, LLC, Sandy, UT (US)

(72) Inventor: Gayle Thomas, Riverton, UT (US)

(73) Assignee: Window Wear, LLC, Sandy, UT (US)

( * ) Notice: Subject to any disclaimer, the term of this patent is extended or adjusted under 35 U.S.C. 154(b) by 0 days.

(21) Appl. No.: 14/024,583

(22) Filed: Sep. 11, 2013

(65) Prior Publication Data

US 2014/0166215 A1 Jun. 19, 2014

Related U.S. Application Data

(60) Provisional application No. 61/699,566, filed on Sep. 11, 2012.

(51) Int. Cl.
*A47H 2/00* (2006.01)

(52) U.S. Cl.
CPC ..... *A47H 2/00* (2013.01); *A47H 2201/01* (2013.01)

(58) Field of Classification Search
CPC ..... A47H 2201/01
USPC ..... 160/21, 38, 39, 123, 124, 126, 349.2, 160/330, DIG. 16
See application file for complete search history.

(56) References Cited

U.S. PATENT DOCUMENTS

| | | | | |
|---|---|---|---|---|
| 1,460,529 | A | 1/1922 | Bishop | |
| 2,212,326 | A * | 8/1940 | Piken | 4/558 |
| 2,992,466 | A | 4/1959 | Lock | |
| 3,111,735 | A * | 11/1963 | Ellis | 24/400 |
| 3,164,352 | A | 1/1965 | Weaver | |
| 3,827,019 | A * | 7/1974 | Serbu | 335/285 |
| 3,924,212 | A | 12/1975 | Brown | |
| 4,304,174 | A * | 12/1981 | Hickson et al. | 454/230 |
| 4,437,505 | A * | 3/1984 | Rodgers | 160/126 |
| 4,582,109 | A | 4/1986 | Fairbanks | |
| 4,594,741 | A * | 6/1986 | Payne | 4/558 |
| 4,802,523 | A * | 2/1989 | Scholten et al. | 160/354 |
| 5,074,348 | A * | 12/1991 | Phillips | 160/38 |
| 5,191,922 | A * | 3/1993 | Wade | 160/124 |
| 5,503,209 | A * | 4/1996 | Healzer et al. | 160/38 |
| 5,524,689 | A | 6/1996 | Clark | |
| 5,597,025 | A * | 1/1997 | Forkner | 160/38 |
| 5,894,642 | A * | 4/1999 | Eberhardt | 24/716 |
| 5,911,266 | A | 6/1999 | Jacobs | |
| 6,192,965 | B1 * | 2/2001 | Hinds | 160/330 |
| 6,301,754 | B1 * | 10/2001 | Grunberger et al. | 24/303 |
| 6,408,927 | B2 | 6/2002 | Kananen | |
| 6,732,783 | B2 * | 5/2004 | Bouldin | 160/348 |
| 7,154,363 | B2 | 12/2006 | Hunts | |
| 7,350,244 | B1 * | 4/2008 | Handley | 4/558 |
| 7,743,813 | B2 * | 6/2010 | Haffamier et al. | 160/39 |
| 2002/0007920 | A1 * | 1/2002 | Lower | 160/38 |
| 2004/0011480 | A1 * | 1/2004 | Andre de la Porte | 160/232 |
| 2004/0209018 | A1 * | 10/2004 | Lookholder | 428/33 |
| 2005/0126577 | A1 | 6/2005 | Griesbach | |

(Continued)

*Primary Examiner* — Katherine Mitchell
*Assistant Examiner* — Justin Rephann
(74) *Attorney, Agent, or Firm* — Thorpe North & Western

(57) ABSTRACT

A magnetic window valance is disclosed. The magnetic window valance can include a sheet of ferromagnetic material, and a decorative layer disposed about the sheet of ferromagnetic material. The magnetic window valance can also include a curtain rod coupling portion extending in a first direction from the decorative layer, and a tab extending in a second direction from the decorative layer and supporting a magnet configured to couple with a proximal magnetic window valance.

15 Claims, 7 Drawing Sheets

(56) References Cited

U.S. PATENT DOCUMENTS

| | | | | |
|---|---|---|---|---|
| 2006/0070705 | A1* | 4/2006 | Haffamier et al. | 160/38 |
| 2006/0139134 | A1* | 6/2006 | Hunts | 335/205 |
| 2008/0017328 | A1* | 1/2008 | Huang | 160/123 |
| 2008/0017332 | A1* | 1/2008 | Daly | 160/330 |
| 2008/0142170 | A1 | 6/2008 | Killian | |
| 2008/0229491 | A1* | 9/2008 | Gregory | 4/558 |
| 2008/0248713 | A1 | 10/2008 | Mulrine | |
| 2008/0283205 | A1* | 11/2008 | Zimmer | 160/330 |
| 2009/0044920 | A1 | 2/2009 | De Angelis | |
| 2009/0083904 | A1* | 4/2009 | Roston | 4/558 |
| 2009/0283197 | A1 | 11/2009 | Gorodisher | |
| 2010/0032536 | A1 | 2/2010 | Eagan | |
| 2010/0051210 | A1 | 3/2010 | Daly | |
| 2010/0107320 | A1 | 5/2010 | Rees | |
| 2010/0181032 | A1 | 7/2010 | Bennett et al. | |
| 2010/0288453 | A1 | 11/2010 | Richardson | |
| 2011/0192949 | A1 | 8/2011 | Zimmerman | |
| 2011/0284172 | A1* | 11/2011 | Seitz | 160/123 |
| 2012/0067531 | A1* | 3/2012 | Ehrsam | 160/368.1 |
| 2012/0067834 | A1* | 3/2012 | Gokey | 211/45 |
| 2012/0261083 | A1* | 10/2012 | Daly | 160/236 |

* cited by examiner

MAGNETIC WINDOW VALANCE

RELATED APPLICATION

This application claims the benefit of U.S. Provisional Application No. 61/699,566 filed Sep. 11, 2012, the content of which is incorporated herein by reference in its entirety.

BACKGROUND

In home décor and interior design, window treatments are often used to add color, pattern, and style to a room. A window valance is a form of window treatment that covers the uppermost part of a window and can be hung alone or paired with window blinds or curtains. Valances are a popular decorative choice for concealing drapery hardware and are available in a wide range of sizes, shapes, and colors. Existing window valance designs typically use a fabric sleeve that is hung on a horizontal rod or sliding track system above the top of a window to decorate the top of the window and hide the supporting hardware. The color, texture, and pattern of the fabric are usually selected to complement the interior design of a room.

Often, it can be desirable to change the color and patterns of a valance according to the changing seasons, holidays, special occasions, or simply to provide a fresh new design. However, current methods of valance installation make it difficult and time consuming to change a window valance. Moreover, the cost to purchase and install valances can be cost prohibitive. For these reasons, it may not be practical or affordable for homeowners and consumers to change their valance window treatments as often as desired.

SUMMARY

A magnetic window valance is disclosed that can comprise a sheet of ferromagnetic material, a decorative layer disposed about the sheet of ferromagnetic material, a curtain rod coupling portion extending in a first direction from the decorative layer, and a tab extending in a second direction from the decorative layer and supporting a magnet to couple with a proximal magnetic window valance.

In addition, a magnetic window valance system is disclosed that can comprise a curtain rod, and a plurality of magnetic window valances. Each magnetic window valance can have a sheet of ferromagnetic material, a decorative layer disposed about the sheet of ferromagnetic material, a curtain rod coupling portion extending in a first direction from the decorative layer, and a tab extending in a second direction from the decorative layer and supporting a magnet. The plurality of magnetic window valances can be coupled to the curtain rod via the curtain rod coupling portions, and proximal magnetic window valances can be coupled to one another via the magnets of the tabs, which magnetically couple with the sheets of ferromagnetic material through the decorative layers.

A magnetic window valance system is also disclosed. The magnetic window valance can include a curtain rod and a plurality of magnetic window valances. Each magnetic window valance can include a sheet of ferromagnetic material, a decorative layer disposed about the sheet of ferromagnetic material, a curtain rod coupling portion extending in a first direction from the decorative layer, and a tab extending in a second direction from the decorative layer to support a magnet. The plurality of magnetic window valances can be coupled to the curtain rod via the curtain rod coupling portions.

In addition, proximal magnetic window valances can be coupled to one another via the magnets of the tabs, which magnetically couple with the sheets of ferromagnetic material through the decorative layers. The magnetic window valance system can also include at least one interchangeable accessory decorating at least one of the magnetic window valances. The interchangeable accessory can have a second magnet to magnetically couple with the sheet of ferromagnetic material through the decorative layer.

BRIEF DESCRIPTION OF THE DRAWINGS

Features and advantages of the disclosure will be apparent from the detailed description which follows, taken in conjunction with the accompanying drawings, which together illustrate, by way of example, features of the disclosure.

Figure 1A:
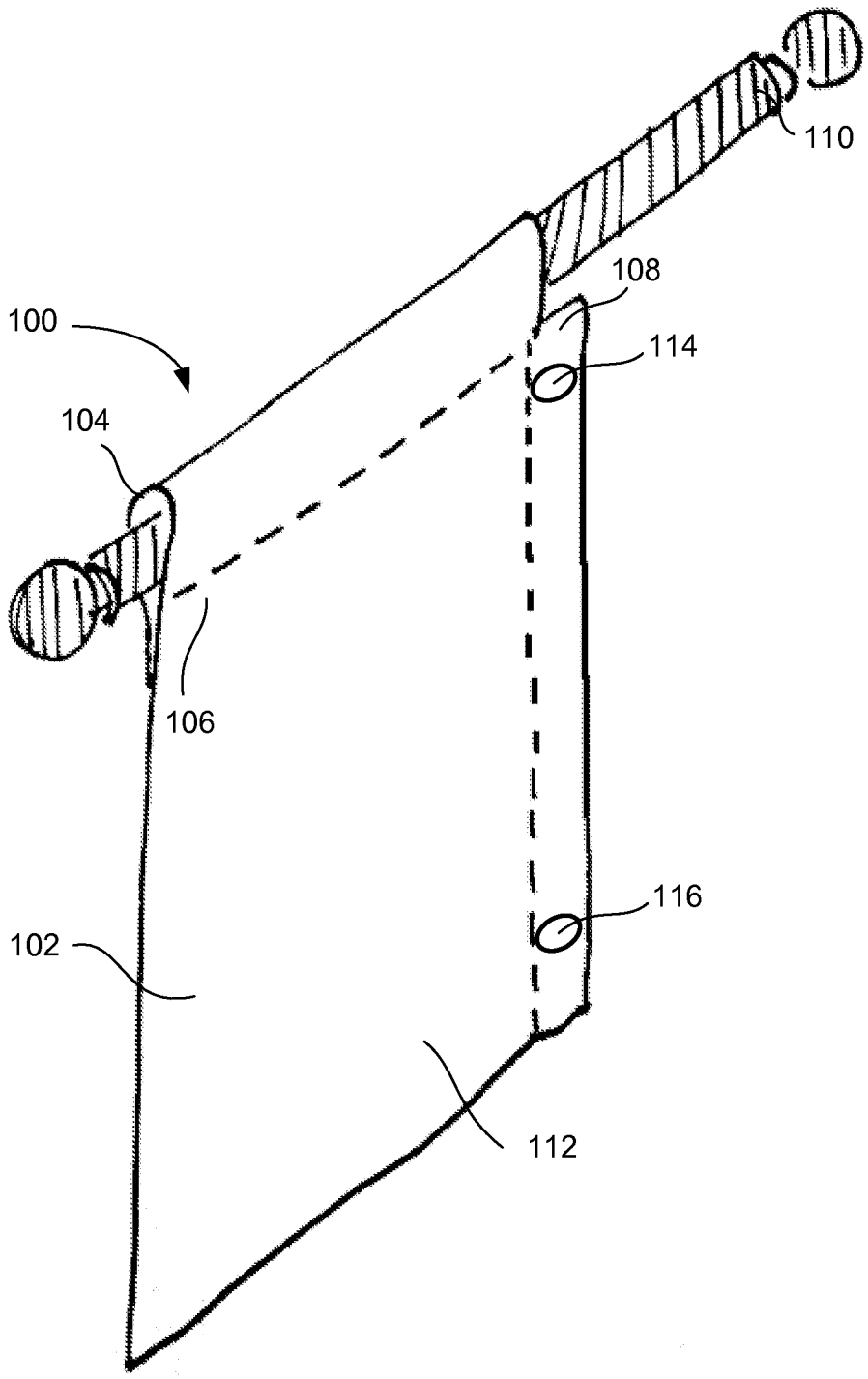
FIG. 1A is a perspective view of a magnetic window valance system in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence.

Example Embodiments

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Reference will now be made to the examples illustrated, and specific language will be used herein to describe the same. It will nevertheless be understood that no limitation of the scope of the technology is thereby intended. Additional features and advantages of the technology will be apparent from the detailed description which follows, taken in conjunction with the accompanying drawings, which together illustrate, by way of example, features of the technology.

In describing and claiming the present invention, the following terminology will be used.

The singular forms "a," "an," and "the" include plural referents unless the context clearly dictates otherwise. Thus, for example, reference to "a sheet" includes reference to one or more of such sheets, and reference to "the tab" refers to one or more of such tabs.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

FIG. 1 illustrates an exemplary magnetic window valance system 100. The magnetic window valance system 100 may include a magnetic window valance 102, a rod pocket 104, magnetic material 106 (as illustrated within the dotted lines), a tab 108, a curtain rod 110, a decorative layer 112, and magnets 114 and 116. In general, the magnetic window valance 102 is a short drapery used as a decorative heading to conceal a top of window curtains and/or window fixtures. The magnetic window valance system 100 may be used to decorate windows located in a home, office building, etc. The magnetic window valance system 100 may provide for easy changing of colors, shapes, or other decorative aspects of the magnetic window valance 102.

The magnetic window valance 102 may include the rod pocket 104, magnetic material 106, the tab 108, the decorative layer 112, and the magnets 114 and 116. In one example, each magnetic window valance 102 may be designed and sold as a reversible panel. The magnetic window valance 102 may attach to the curtain rod 110 to form the magnetic window valance system 100.

In one configuration, the magnetic material 106 may include the magnetic material 106, such as magnetic sheet metal. The magnetic sheet metal may be beneficial due to a high surface area to thickness ratio, which provides for a relatively large available coupling area for interchangeable decorative accessories, such as those shown in FIGS. 2A-2C, while being thin enough to fit within a typical-sized valance panel. In one aspect, the magnetic material 106 can comprise a ferromagnetic material including, but not limited to, chromium oxide, cobalt, dysprosium, ferrite, gadolinium, gallium manganese arsenide, iron, magnetite, neodymium, nickel, samarium-cobalt, suessite, and yttrium iron garnet.

The magnetic window valance system 100 can also include a decorative layer 112 disposed about the magnetic material 106. In other words, the decorative layer 112 may be wrapped around the magnetic material 106. Thus, the decorative layer 112 may enclose the magnetic material 106, such that the magnetic material 106 may not be viewable when the magnetic window valance system 100 decorates the window. The dotted lines illustrate an example boundary of the magnetic material 106. The decorative layer 112 can be made of any suitable material and, in general, may include a textile material. In addition, the decorative layer 112 may be made from plastic, mylar, flash spun polyester fibers (e.g., Tyvek®), or other types of synthetic sheet material. The decorative layer 112 can include any suitable color, shape, or other decorative aspect of the magnetic window valance 102.

In one example, the magnetic material 106 is permanently attached to the decorative layer 112 and may not be removed. In an alternative example, the magnetic material 106 can be removable from the decorative layer 112. In one aspect, because the decorative layer 112 can form a visual backdrop for the interchangeable decorative accessories attached to the magnetic material 106, the material of the decorative layer 112 can be selected to include a color and/or design that is likely to be compatible with the color and/or design of the interchangeable decorative accessories.

In one configuration, the decorative layer 112 may comprise a single layer of decorative material on at least one side of the magnetic material 106, such as a sheet of ferromagnetic material. In this case, the decorative layer 112 can be adhered to or otherwise coupled with the magnetic material 106 such that the decorative layer 112 effectively covers a side of the magnetic material 106 exposed to view. In another aspect, the decorative layer 112 can comprise a pocket and the magnetic material 106 can be disposed in the pocket. The magnetic material 106 may fill the pocket or just a portion of the pocket. For example the pocket could be divided into sub-areas and the magnetic material 106 may be located in a sub-area of the magnetic window valance 102 to engage the magnets while using a smaller sheet of the magnetic material 106. Further, some areas of the sheet may not be ferromagnetic. For example, portions of the magnetic material may be surrounded by or embedded in paper or plastic as a placeholder or filler.

In one configuration, the magnetic window valance 102 may mount onto a standard rod system, such as the curtain rod 110. The magnetic window valance 102 may include the rod pocket 104 to attach to the curtain rod 110. Alternatively, the magnetic window valance 102 may be supported by another existing type of drapery support structure. Since the magnetic window valance 102 can be configured to couple with the curtain rod 110 or other support hardware, the magnetic window valance 102 can include a curtain rod coupling portion (i.e., the rod pocket 104) extending in a first direction from the decorative layer 112. In one aspect, the curtain rod coupling portion (i.e., the rod pocket 104) can comprise an envelope having open ends to facilitate extension of the curtain rod 110 therethrough. It should be recognized that the curtain rod coupling portion can include any suitable form of coupling feature for coupling with a rod or support structure, such as an existing valance or curtain coupling feature or device. Such coupling features can include loops, clips, straps, hooks, etc.

In one configuration, the magnetic window valance 102 may include the tab 108. The tab 108 may extend in a second direction from the decorative layer 112 and support the magnets 114 and 116 to couple with a proximal magnetic window valance (not shown in FIG. 1A). In other words, a first magnetic window valance 102 may be coupled to a second magnetic window valance (not shown) using the magnets in the tab of the first magnetic window valance. The magnets in the tab 108 of the first magnetic window valance 102 may be attracted to the magnetic material included in the second magnetic window valance, thereby magnetically coupling the first magnetic window valance 108 with the second magnetic window valance. Therefore, two magnetic window valances may be coupled using the magnets 114 and 116 in the tab 108.

Figure 1B:
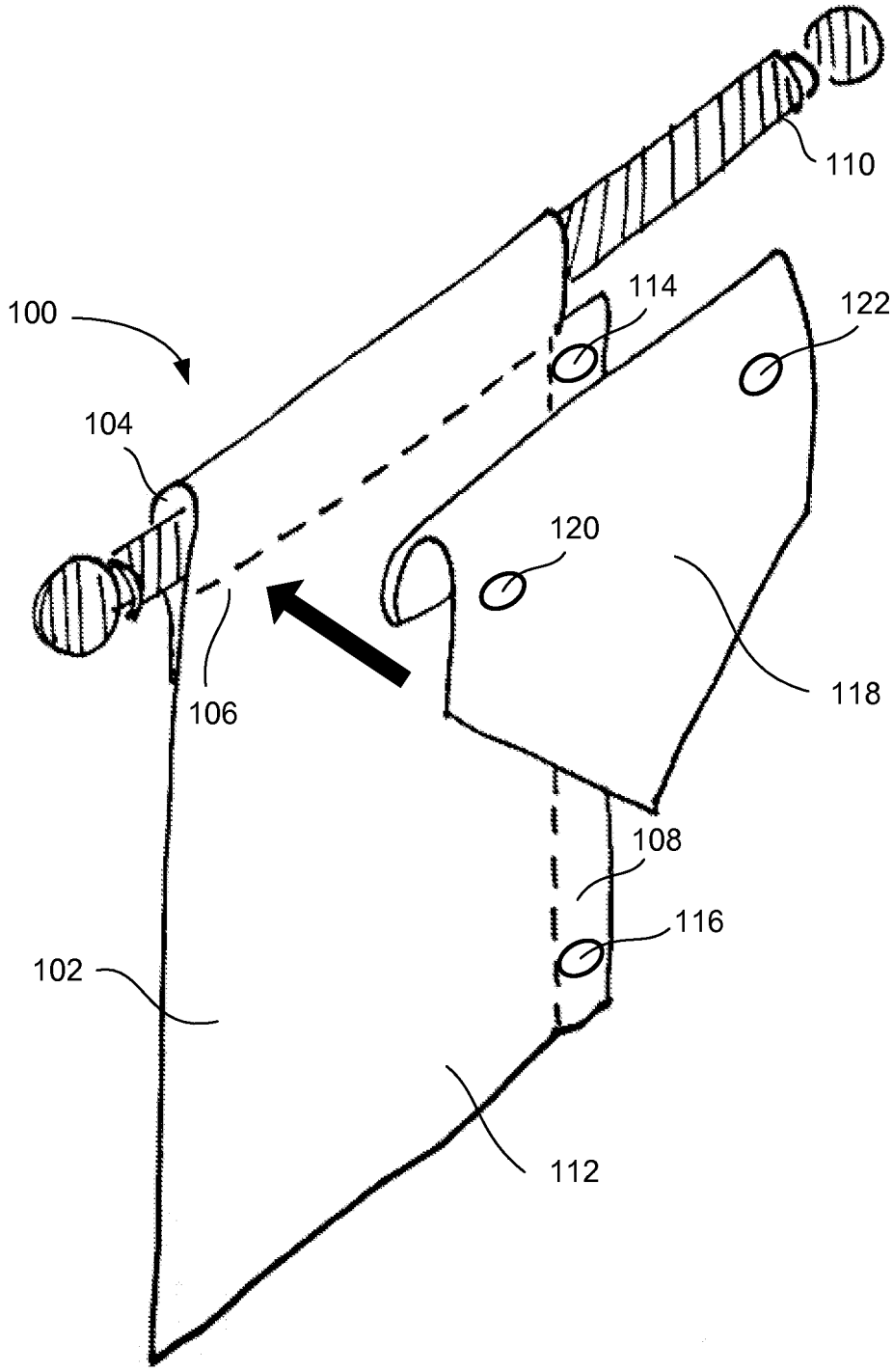
FIG. 1B is a perspective view of a magnetic window valance system that includes an interchangeable decorative accessory in accordance with an example of the present disclosure.

FIG. 1B is a perspective view of a magnetic window valance system 100 that includes an interchangeable decorative accessory 118. In addition, the magnetic window valance system 100 may include the magnetic window valance 102, the rod pocket 104, magnetic material 106, the tab 108, the curtain rode, the decorative layer 112, and magnets 114 and 116. The interchangeable decorative accessory 118 can include magnets 120 and 122 to magnetically couple with the magnetic material 106 through the decorative layer 112 of the magnetic window valance 102. In other words, the magnets 120 and 122 may be used to dress the magnetic window valance 102 with the interchangeable decorative accessory 118. The magnets are shown in dotted lines because the magnets may not be visible through the valence material 112. In one example, the magnets 120 and 122 are industrial strength magnets that are sewn directly into holding points in the interchangeable decorative accessory 118. Alternatively, the magnets 120 and 122 may be attached to the interchangeable decorative accessory 118 using glue or a similar adhesive. Thus, the magnetic window valance 102 may be quickly and easily decorated with the interchangeable decorative accessory 118. In addition, the use of magnets may avoid sewing or measuring when attaching the interchangeable decorative accessory 118 to the magnetic window valance 102.

In one example, the magnetic window valance 102 can include the magnetic material 106 that can be used to couple with and support an interchangeable decorative accessory used to decorate the magnetic window valance 102. A portion of the magnetic window valance 102 can remain attached to the rod 108 or support structure and interchangeable decorative accessories can be added or removed, easily and without tools, according to the desires of the user or decorator.

As shown in FIG. 1B, the interchangeable decorative accessory 118 may be a flap. However, a variety of interchangeable decorative accessories may be coupled to the magnetic window valance 102 using one or more magnets. For example, the interchangeable decorative accessories may include, but are not limited to, bands, banners, bead trims, flaps, jabots, fringe trims, medallions, swags, tape trims, and tassels. Each of the interchangeable decorative accessories may include one or more magnets, so that the interchangeable decorative accessories may be placed anywhere on the magnetic window valance 102. Since the magnetic material 106 in the magnetic window valance 102 may be attracted to the magnets in the interchangeable decorative accessories, the interchangeable decorative accessories may be firmly (but removably) attached to the magnetic window valance 102.

The variety of interchangeable decorative accessories may be mixed and matched to create a specific design for a particular customer. Thus, the assembly of the interchangeable decorative accessories may create a look that is modern, contemporary, traditional, youthful, feminine, masculine, outdoorsy, etc. In one example, the band accessory or the tape trim accessory can be placed across the bottom, middle or top of the magnetic window valance 102. In general, the interchangeable decorative accessories, such as the banner accessory, may be used with a single magnetic window valance or a series of magnetic window valances.

In one configuration, the flap accessory can be alternated with the banner accessory which hangs longer than the flap accessory. The band accessory may be added at the bottom of the magnetic window valance 102 or across the face of the flap accessory. In addition, the medallion accessory may be placed at the point of the flap accessory. The jabot accessory may be placed in between the flap accessory, or one flap accessory may be layered over another flap accessory.

The jabot accessory may offer an appearance that is formal or traditional. Thus, the jabot accessory may be used for windows located in home offices, living rooms, dining rooms, etc. In one configuration, the jabot accessory may be paired with the swag accessory to provide a formal or traditional appearance. As an example, the jabot accessory may be placed on a first magnetic window valance and a last magnetic window valance in a series of magnetic window valances. Alternatively, the jabot accessory may be placed on every other magnetic window valance in the series of magnetic window valances.

The fringe trim accessory may create a softer look for the magnetic window valance 102. The fringe trim accessory may be paired with a number of interchangeable decorative accessories, such as the band accessory, the flap accessory, or the banner accessory. The medallion accessory may add a formal or traditional look to the magnetic window valance 102. The medallion accessory may be placed anywhere on the magnetic window valance 102 and layered with other interchangeable decorative accessories.

The swag accessory may offer a formal appearance that adds softness and texture to the magnetic window valance 102. The swag accessory may be used with a variety of interchangeable decorative accessories, such as the medallion accessory. In addition, the tassel accessory may be placed anywhere on the magnetic window valance 102, including behind the magnetic window valance 102 with the bottom of the tassel accessory hanging below the magnetic window valance 102.

Figure 2A:
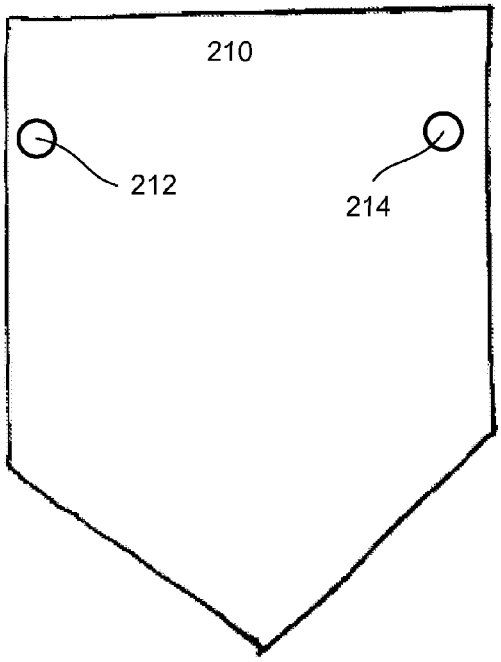
FIGS. 2A-2C illustrate examples of interchangeable decorative accessories for decorating the magnetic window valance in accordance with an example of the present disclosure.
Figure 2B:
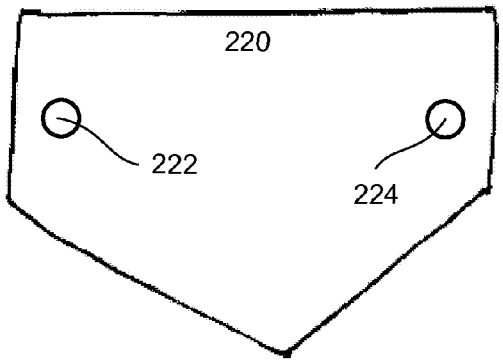
Figure 2C:
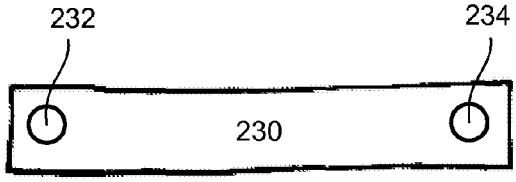

FIGS. 2A to 2C illustrate examples of interchangeable decorative accessories 210, 220 and 230 for decorating the magnetic window valance 102. FIG. 2A illustrates a flap accessory 210 that may be magnetically coupled to the magnetic window valance 102 using the magnets 212 and 214. FIG. 2B illustrates a banner accessory 220 that may be magnetically coupled to the magnetic window valance 102 using the magnets 222 and 224. FIG. 2C illustrates a band accessory 230 that may be magnetically coupled to the magnetic window valance 102 using the magnets 232 and 234.

As previously discussed, the interchangeable decorative accessories 210, 220 and 230 may include one or more magnets to magnetically couple the interchangeable decorative accessories 210, 220 and 230 to the magnetic window valance 102. In particular, the magnets in the interchangeable decorative accessories 210, 220 and 230 may be attracted to the magnetic material 106 contained in the magnetic window valance 102. In addition to the interchangeable decorative accessories shown in FIGS. 2A to 2C, the interchangeable decorative accessories may include, but are not limited to, jabots, medallions, swags, tassels, trims, or combinations thereof.

Figure 3:
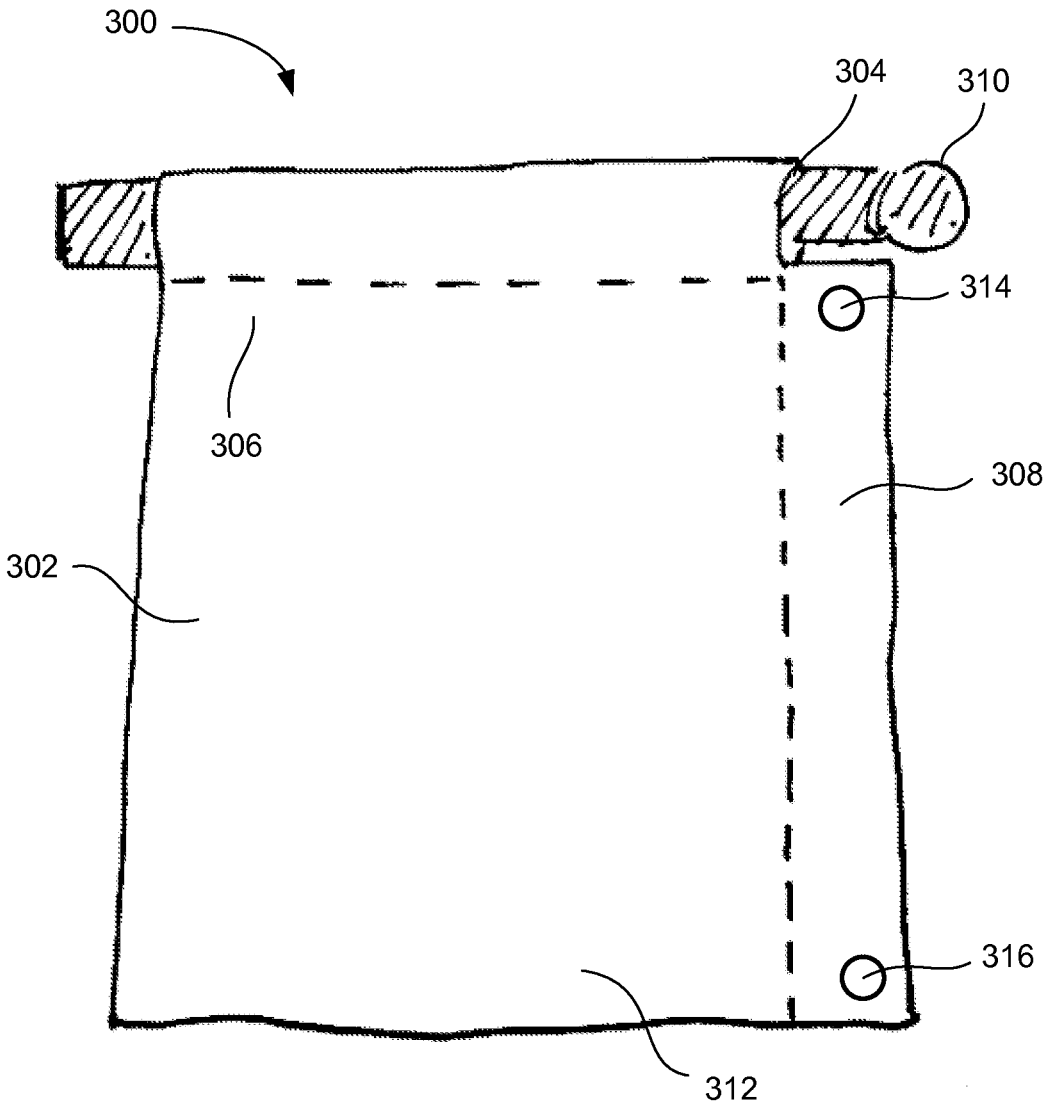
FIG. 3 is a front view of a magnetic window valance system in accordance with an example of the present disclosure.

FIG. 3 is an additional front view of an exemplary magnetic window valance system 300. The magnetic window valance system 300 may include a magnetic window valance 302, a rod pocket 304, magnetic material 306, a tab 308, a curtain rod 310, a decorative layer 312, and magnets 314 and 316. The magnetic window valance 302 may include the rod pocket 304, magnetic material 306, the tab 308, the decorative layer 312, and the magnets 314 and 316. In one configuration, the magnetic window valance 302 may mount onto a standard pocket rod system, such as the curtain rod 310. The magnetic window valance 302 may be attached to the curtain rod 310 using the rod pocket 304. In addition, the magnetic window valance system 300 may include one or more interchangeable decorative accessories (not shown in FIG. 3), such as flaps, bands, and banners.

Figure 4:
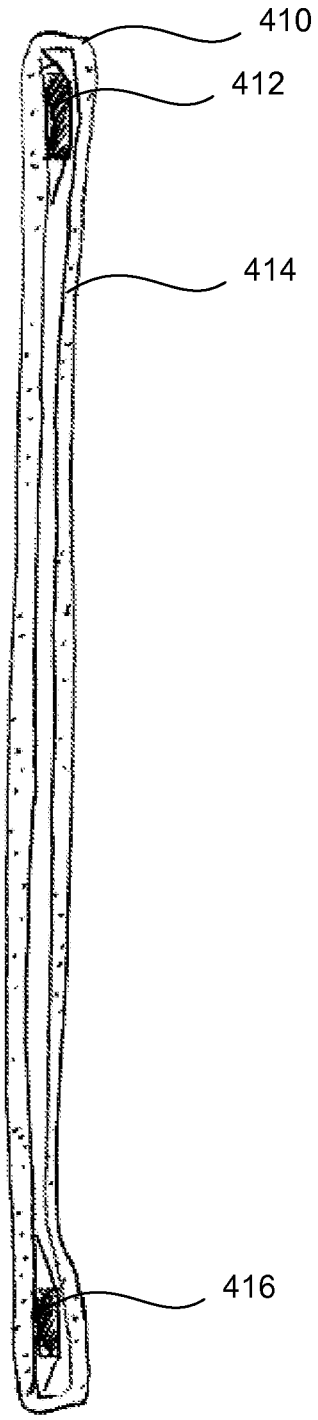
FIG. 4 is a cross-sectional side view of a tab included in a magnetic window valance in accordance with an example of the present disclosure.

FIG. 4 is a cross-section view of a tab 410 included in the magnetic window valance 302 (FIG. 3). In general, the tab 410 may be used to connect a series of magnetic window valances. The tab 410 may be formed by a decorative layer 414 or a decorative layer covered by a support layer. In addition, the decorative layer 414 may enclose the magnets 412 and 416. As shown in FIG. 4, the magnets 412 and 416 may be positioned in pockets 418 and 420, respectively, which can be sewn into the decorative layer 414. In an alternative configuration, the magnets 412 and 416 may be attached to the decorative layer 414 using, for example, glue or a similar adhesive.

Figure 5:
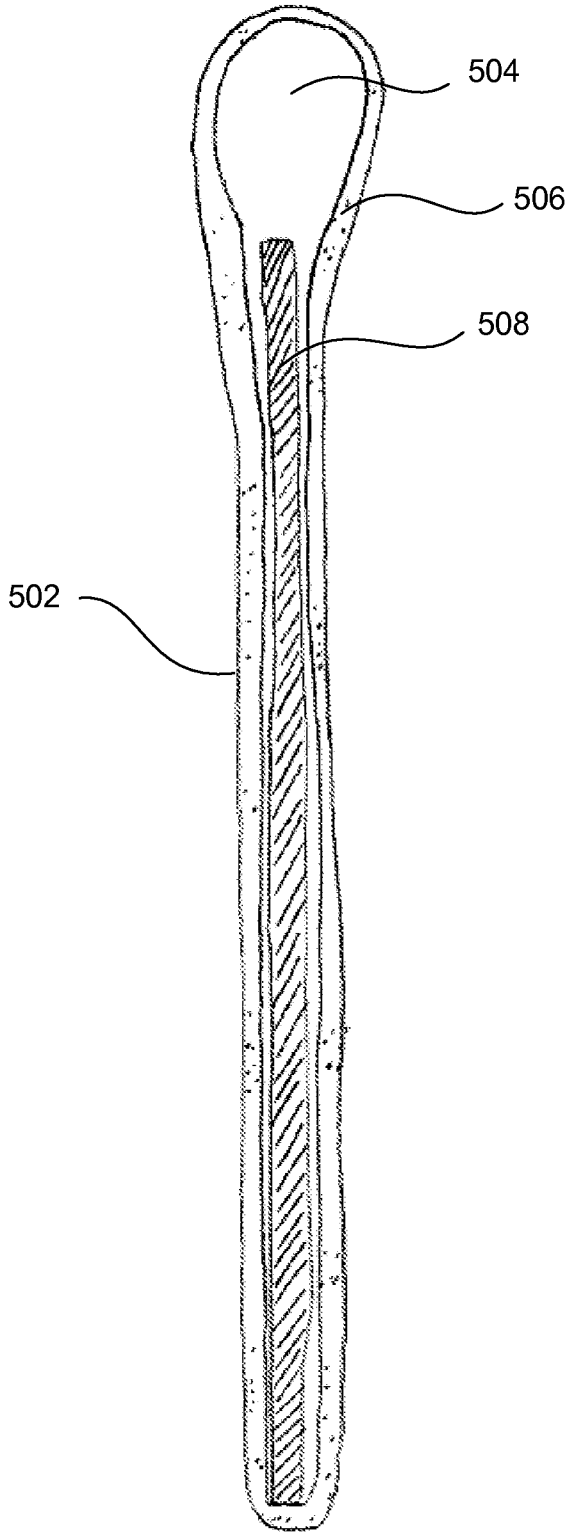
FIG. 5 is a cross-sectional side view of a magnetic window valance in accordance with an example of the present disclosure.

FIG. 5 is a cross-section view of a magnetic window valance 502. The magnetic window valance 502 may include a decorative layer 506 that is wrapped around a magnetic material 508. Thus, the decorative layer 506 may enclose the magnetic material 508, such that the magnetic material 508 is not viewable when the magnetic window valance 502 decorates a window. The decorative layer 506 can be made of any suitable material and may include a textile material. In one example, the magnetic material 508 may be ferromagnetic sheet metal to allow interchangeable decorative accessories to be magnetically coupled to the magnetic window valance 502. In addition, the magnetic window valance 502 may include a rod pocket 504 to attach the magnetic window valance 502 to a curtain rod (not shown in FIG. 5).

Figure 6:
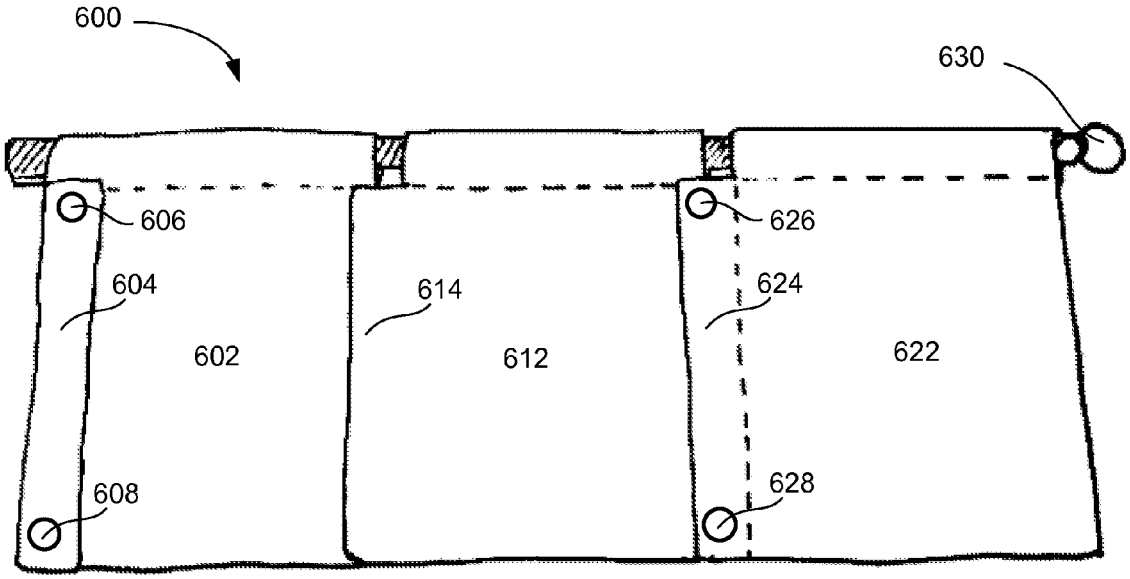
FIG. 6 is a front view of a magnetic window valance system with multiple window valence elements in accordance with an example of the present disclosure.

FIG. 6 is a front view of a magnetic window valance system 600. As shown in FIG. 6, a series of magnetic window valances 602, 612, 622 may be disposed side-by-side to span a width of a window. Alternatively, a single magnetic window valance may be sized or configured to span a significant portion of a width of the window. This modularity can provide flexibility in using the magnetic window valances 602, 612 and 622 with a wide range of window sizes. In addition, the magnetic window valances 602, 612 and 622 may be attached to a support structure, such as a curtain rod 630.

The magnetic window valances 602, 612 and 622 may include tabs 604, 614, and 624, respectively. The tabs 604, 614 and 624 may support one or more magnets (e.g., magnets 606, 608, 626 and 628) to couple proximal magnetic window valances together. For example, the tab 624 (and the magnets 626 and 628 that are attached to the tab 624) may couple the magnetic window valance 622 with the magnetic window valance 612.

In one example, one of the magnetic window valances can be disposed at an end of the series of magnetic window valances along the curtain rod 630, such that no magnetic window valance is proximal to the tab of the end magnetic window valance. For example, the magnetic window valance 602 may be the end magnetic window valance (e.g., the left most or right most magnetic window valance) in a series of three magnetic window valances. Thus, in one aspect, the tab 604 can be foldable to facilitate magnetically coupling the magnets 606 and 608 with the magnetic material of the end magnetic window valance (e.g., the magnetic window valance 602) through the decorative layer. This folding can be useful to neatly secure the tab 604 of the magnetic window valance 602 disposed at the end of the series of proximal magnetic window valances (i.e., no additional magnetic window valances are located proximally to the tab 604). Securing the tab 604 may provide a clean look so that the tab 604 does not dangle off the end of the magnetic window valance system 600. In other words, the tab 604 may not be viewable when the tab 604 is folded behind the magnetic window valance 602. In addition, the magnets 606 and 608 may be attracted to magnetic material included in the magnetic window valance 602, such that the tab 604 can be neatly folded behind the magnetic window valance 602.

While the forgoing examples are illustrative of the principles of the present technology in one or more particular applications, it will be apparent to those of ordinary skill in the art that numerous modifications in form, usage and details of implementation can be made without the exercise of inventive faculty, and without departing from the principles and concepts of the technology. Accordingly, it is not intended that the technology be limited, except as by the claims set forth below.

What is claimed is:

1. A magnetic window valance for use with a curtain rod, comprising:

a sheet of ferromagnetic material;

a decorative layer disposed about the sheet of ferromagnetic material, and the sheet of ferromagnetic material is sized to be substantially a same size as the decorative layer;

a curtain rod coupling portion extending in a first direction from the decorative layer;

a tab extending in a second direction from the decorative layer and supporting a magnet configured to couple with a proximal magnetic window valance; and wherein the tab is foldable to facilitate magnetically coupling the magnet with the sheet of ferromagnetic material through the decorative layer.

2. The magnetic window valance of claim 1, further comprising an interchangeable accessory to decorate the magnetic window valance, the interchangeable accessory having a second magnet to magnetically couple with the sheet of ferromagnetic material through the decorative layer.

3. The magnetic window valance of claim 1, wherein the magnetic window valance is coupled to the proximal magnetic window valance via the magnets of the tab which magnetically couple with the sheet of ferromagnetic material through the decorative layer of the proximal magnetic window valance.

4. The magnetic window valance of claim 1, wherein the decorative layer comprises a pocket and the sheet of ferromagnetic material is disposed in the pocket.

5. The magnetic window valance of claim 1, wherein the decorative layer comprises a single layer of textile material on at least one side of the sheet of ferromagnetic material.

6. The magnetic window valance of claim 1, wherein the curtain rod coupling portion comprises an envelope having open ends to facilitate extension of the curtain rod therethrough.

7. A magnetic window valance system for use with a curtain rod, comprising:

a plurality of magnetic window valances, each magnetic window valance having:

a sheet of ferromagnetic material, a decorative layer disposed about the sheet of ferromagnetic material, a curtain rod coupling portion extending in a first direction from the decorative layer, and a tab extending in a second direction from the decorative layer and supporting a magnet, wherein the plurality of magnetic window valances are coupled to the curtain rod via the curtain rod coupling portions, and proximal magnetic window valances are coupled to one another via the magnets of the tabs, which magnetically couple with the sheets of ferromagnetic material through the decorative layers; and wherein one of the plurality of magnetic window valances is disposed at an end of a series of magnetic window valances along the curtain rod, such that no magnetic window valance is proximal to the tab of an end magnetic window valance, and wherein the tab is foldable to facilitate magnetically coupling the magnet with the sheet of ferromagnetic material of the end magnetic window valance through the decorative layer.

8. The system of claim 7, further comprising at least one interchangeable accessory decorating at least one of the magnetic window valances, the at least one interchangeable accessory having a second magnet to magnetically couple with the sheet of ferromagnetic material through the decorative layer.

9. The system of claim 7, wherein the decorative layer comprises a pocket and the sheet of ferromagnetic material is disposed in the pocket.

10. The system of claim 7, wherein the decorative layer comprises a single layer of textile material on at least one side of the sheet of ferromagnetic material.

11. A magnetic window valance system for use with a curtain rod, comprising:

a plurality of magnetic window valances, each magnetic window valance having a sheet of ferromagnetic material, a decorative layer disposed about the sheet of ferromagnetic material, a curtain rod pocket extending in a first direction from the decorative layer, and a tab extending in a second direction from the decorative layer and supporting a first magnet;

an interchangeable accessory to decorate the magnetic window valance, the interchangeable accessory having a second magnet to magnetically couple with the sheet of ferromagnetic material through the decorative layer of the magnetic window valance; and wherein one of the plurality of magnetic window valances is disposed at an end of a series of magnetic window valances along the curtain rod, such that no magnetic window valance is proximal to the tab of an end magnetic window valance, and wherein the tab is foldable to facilitate magnetically coupling the magnet with the sheet of ferromagnetic material of the end magnetic window valance through the decorative layer.

12. The system of claim 11, wherein the magnetic window valances are coupled to the curtain rod via the curtain rod pocket.

13. The system of claim 11, wherein proximal magnetic window valances are coupled to one another via the magnets of the tabs, which magnetically couple with sheets of ferromagnetic material through the decorative layer.

14. The system of claim 11, wherein the decorative layer comprises a pocket and the sheet of ferromagnetic material is disposed in the pocket.

15. The system of claim 11, wherein the decorative layer comprises a single layer of textile material on at least one side of the sheet of ferromagnetic material.

* * * * *